US010889980B2

(12) United States Patent
Dean et al.

(10) Patent No.: US 10,889,980 B2
(45) Date of Patent: Jan. 12, 2021

(54) METHOD FOR CONSTRUCTING A MULTI-STAGE BLOCK WALL

(71) Applicant: Dean Holding Corporation, Lake Elmo, MN (US)

(72) Inventors: Patrick E. Dean, Lake Elmo, MN (US); Daniel J. Curry, Crystal, MN (US); J. Matthew Kempainen, Mendota Heights, MN (US); Kong Cheng Moua, Minneapolis, MN (US); Michael Stoneburner, St. Paul, MN (US); Daniel Sylvestre, Falcon Heights, MN (US)

(73) Assignee: Dean Holding Corporation, Lake Elmo, MN (US)

( * ) Notice: Subject to any disclaimer, the term of this patent is extended or adjusted under 35 U.S.C. 154(b) by 0 days.

(21) Appl. No.: 16/901,212

(22) Filed: Jun. 15, 2020

(65) Prior Publication Data

US 2020/0308825 A1 Oct. 1, 2020

Related U.S. Application Data

(63) Continuation of application No. 16/116,081, filed on Aug. 29, 2018, now Pat. No. 10,718,108, which is a (Continued)

(51) Int. Cl.
*E04B 1/41* (2006.01)
*E02D 29/02* (2006.01)
(Continued)

(52) U.S. Cl.
CPC ..... *E04B 1/4185* (2013.01); *E02D 29/02* (2013.01); *E02D 29/025* (2013.01);
(Continued)

(58) Field of Classification Search
None
See application file for complete search history.

(56) References Cited

U.S. PATENT DOCUMENTS 1,226,214 A * 5/1917 Hopkins ..... 52/426
1,329,893 A 2/1920 Flynn
(Continued)

FOREIGN PATENT DOCUMENTS

GB 707479 4/1954

OTHER PUBLICATIONS

Quad-Lock Ties, Quad-Lock Concrete Building Solutions, 2011; http://www.quadlock.com/insulated-concrete-forms/ties.htm.

*Primary Examiner* — Joshua K Ihezie
(74) *Attorney, Agent, or Firm* — Boyle Fredrickson, S.C.

(57) ABSTRACT

A bridge to construct a multi-stage wall is provided with a clip at each end. One of the clips is sized and shaped to fit snugly onto the wall of a standard concrete masonry unit (CMU), while the other is sized and shaped to fit onto a segmental wall system (SWS) unit. A retaining or stand-alone wall is constructed by laying a row of SWS units and a row of CMUs roughly parallel to each other, with bridges extending between them to fix the units. The hollow spaces in each unit and the space between the rows is filled with gravel, rock or other fill material as each course is laid. Additional courses of SWS units and CMUs are placed on top of the prior courses, with bridges added to each course. This process is repeated until the desired wall height is reached. Various sized and shaped clips and connector brackets are provided to allow spacing of the walls at different distances, with varying blocks. Multiple walls can be constructed in parallel and connected with bridges to provide sufficient retention mass for taller walls.

15 Claims, 4 Drawing Sheets

Related U.S. Application Data continuation of application No. 15/034,928, filed as application No. PCT/US2014/068965 on Dec. 6, 2014, now Pat. No. 10,202,756.

(60) Provisional application No. 61/913,278, filed on Dec. 7, 2013.

(51) Int. Cl.

| | |
|---|---|
| ***E04B 1/04*** | (2006.01) |
| ***E04B 2/44*** | (2006.01) |
| ***E04B 2/54*** | (2006.01) |
| *E04B 2/02* | (2006.01) |

(52) U.S. Cl.

CPC ..... *E02D 29/0266* (2013.01); *E04B 1/043* (2013.01); *E04B 2/44* (2013.01); *E04B 2/54* (2013.01); *E04B 2002/0282* (2013.01)

(56) References Cited

U.S. PATENT DOCUMENTS

| | | | |
|---|---|---|---|
| 2,181,698 | A | 11/1939 | Langenberg |
| 3,759,003 | A | 9/1973 | Wilson |
| 4,263,765 | A | 4/1981 | Maloney |
| 4,597,236 | A | 7/1986 | Braxton |
| 4,706,429 | A | 11/1987 | Young |
| 4,889,310 | A | 12/1989 | Boeshart |
| 5,209,039 | A | 5/1993 | Boeshart |
| 5,350,256 | A | 9/1994 | Hammer |
| 5,570,552 | A | 11/1996 | Nehring |
| 5,611,183 | A | 3/1997 | Kim |
| 5,701,710 | A | 12/1997 | Tremelling |
| 5,845,448 | A | 12/1998 | Potvin |
| 5,852,907 | A | 12/1998 | Tobin et al. |
| 5,992,114 | A | 11/1999 | Zelinsky et al. |
| 6,247,280 | B1 | 6/2001 | Grinshpun et al. |
| 6,250,033 | B1 | 6/2001 | Zelinsky |
| 6,698,710 | B1 | 3/2004 | VanderWerf |
| 6,935,081 | B2 | 8/2005 | Dunn et al. |
| 7,827,752 | B2 | 11/2010 | Scherrer |
| 8,279,021 | B2 | 10/2012 | Quinones |
| 8,567,750 | B2 | 10/2013 | Amend |
| 9,441,342 | B2 | 9/2016 | Castonguay et al. |
| 9,702,110 | B1 | 7/2017 | Hilfiker et al. |
| 2005/0028466 | A1 | 2/2005 | Titishov |
| 2007/0003380 | A1 | 1/2007 | Knudson et al. |
| 2007/0245678 | A1 | 10/2007 | Bonelli |
| 2008/0057801 | A1 | 3/2008 | Duffy |
| 2008/0244995 | A1 | 10/2008 | Kemp |
| 2009/0041552 | A1 | 2/2009 | Hammer |
| 2009/0113835 | A1 | 5/2009 | Banova |
| 2009/0308011 | A1 | 12/2009 | Philippe |
| 2011/0000161 | A1 | 1/2011 | Aube et al. |
| 2012/0073229 | A1 | 3/2012 | Castonguay et al. |
| 2015/0159339 | A1 | 6/2015 | Castonguay et al. |

* cited by examiner

METHOD FOR CONSTRUCTING A MULTI-STAGE BLOCK WALL

CROSS-REFERENCE TO RELATED APPLICATIONS

This application is a continuation of U.S. application Ser. No. 16/116,081 filed Aug. 29, 2018, which is a continuation of U.S. application Ser. No. 15/034,928 filed May 6, 2016, now U.S. Pat. No. 10,202,756, issued Feb. 12, 2019, which is a 371 of PCT/US2014/068965, filed Dec. 6, 2014, which claims the benefit of U.S. Provisional Application No. 61/913,278, filed on 7 Dec. 2013, the disclosure of which is incorporated herein by reference in its entirety.

TECHNICAL FIELD

The invention relates to connector systems for multi-stage walls, including retaining walls and stand-alone walls.

BACKGROUND

By definition, a retaining wall is designed to retain dirt. The dirt exerts an outward pressure on the wall, which the wall must be able to withstand. The taller the wall, the more pressure the dirt applies to the wall, so the more pressure the wall must be able to withstand. The ability of the wall to withstand pressure from the dirt is tied directly to the effective mass of the wall. The taller the wall, the more mass is required.

A common way to build tall walls is to use very massive blocks. The blocks may be natural boulders, but more commonly are prefabricated concrete blocks. If made of concrete, they often have mechanisms to interlock with adjacent blocks, and may have a surface formed to look like smaller blocks.

This approach works, but has the disadvantage that the blocks normally must be put in place using heavy construction equipment. That means the heavy construction equipment must be able to reach to location in which the blocks will be placed and requires skill in using the equipment, both of which limit the range of potential uses and add to the cost of building the wall. In addition, the scale is aesthetically inappropriate for smaller landscaping applications.

A second approach used both with massive blocks and smaller blocks suitable for landscaping is to use a geogrid to turn the mass of part of the dirt into part of the effective mass of the wall. A geogrid is a sheet of fabric or mesh, typically of a plastic polymer or metal, which is placed between rows of blocks in the wall as the wall is built, and extends back into the dirt. An example is shown in U.S. Pat. No. 6,447,211 (Scales et al.). To use it, the dirt is excavated back from where the wall will be and the first few rows of the wall are put in place. One end of the geogrid then is placed on top of the partial wall and laid out into the excavated area. Several more rows are built, and then the area on top of the geogrid is back-filled, typically with a layer of gravel next to the wall to provide drainage, and the excavated dirt further from the wall. A new layer of geogrid is laid down, and the process is repeated until the wall reaches the desired height. Variants on geogrid include wall anchors and wall nails, which are simply different structures to engage the dirt.

The advantage to this approach is that it turns the portion of the dirt which is between the geogrid layers into part of the effective mass of the wall. The disadvantage is that the dirt must be excavated quite far back—much farther than is necessary to build the wall itself. And the higher the wall, the farther back the excavation must go. Depending on the nature of the ground, this may be very difficult to do, and usually requires excavating equipment.

A third approach is to build a two-stage wall. In this approach, two stone walls are built adjacent to, but spaced from, each other. A connector of some sort (wood, stone, metal, plastic) is used to bridge the gap between the walls at intervals to stabilize the walls against each other, and the space between the walls then is filled with rubble. This approach dates back at least to the Middle Ages, and is how the curtain walls of most castles were built. It sometimes is referred to as a crypt construction.

In more modern construction, the two walls typically are built of prefabricated concrete blocks or slabs, and the connectors between them are usually formed of metal. Examples of this type of construction can be found in U.S. Pat. No. 6,802,675 (Timmons et al.) and U.S. Pat. No. 8,616,807 (Ogrochock). In this approach, reinforcing wire mesh of the type usually used to reinforce concrete pavement is attached to the inner wall. Links are connected to the outer wall, and then it all is wired together. The space between the walls is filled with gravel, rock or concrete.

The advantages to this construction technique are that it uses the same techniques and equipment as typical highway construction, that it can extend to considerable heights and hold back the consequent substantial pressures. Relatively little excavation is required behind the wall—just the amount needed to be filled with gravel to provide drainage. The disadvantages to this construction technique are that the materials are relatively expensive, and it is very labor intensive, since each of the connectors must be wired or bolted into place between the walls. As a result, it is primarily used in highway construction, where the advantages strongly outweigh the disadvantages.

Another approach designed for use in construction of smaller walls is shown in US2012/073229 (Castonguay et al.) and U.S. Pat. No. 5,845,448 (Potvin). In this approach, the blocks have keyhole slots in them into which the ends of a connector are inserted to hold the blocks in the two walls in position, or the blocks have protrusions around which the connector ends fit. The connectors may have interconnections, to make them longer or to connect them cross-wise. The connectors preferably are formed of plastic. The space between the walls then is filled with gravel or rock. This structure can be used to form a two-stage retaining wall, and can also be used to build a stand-alone wall wider than the width of the blocks used to build it.

The primary advantage to this approach is that it can be used with smaller blocks, suitable for placement by hand. This dramatically expands the flexibility and range of use of the system, for example, it can easily be used for landscaping without the use of heavy construction equipment. The disadvantage of this approach is that it requires specialized blocks with keyhole slots or protrusions, which adds considerably to the cost of the blocks.

SUMMARY OF THE INVENTION

As will be apparent, it would be desirable to provide a low cost, easy to install bridge system to connect the opposite walls of a two-stage wall. In addition, it would be desirable to minimize the necessary cost of the blocks, especially the blocks which will be buried in the dirt and are not visible.

Concrete masonry units (CMUs) normally are formed in the shape of a squared-off number 8, with side walls surrounding two hollow spaces. This shape provides structural strength, while minimizing the amount of concrete needed to make a CMU, as well as making them lighter and easier to handle. Most CMUs have completely hollow spaces inside of them, however, some have concrete covering one end of each hollow space (top fill) and some are completely filled (solid fill).

The external faces of the CMUs are typically flat concrete. CMUs are used in an enormous range of applications, from foundations to buildings to retaining walls. They are produced in enormous volume, and are the lowest cost masonry building units available. CMUs come in a wide variety of sizes. The most common CMU in the US has nominal dimensions of are 8" (203 mm) deep×8" (203 mm) high×16" (406 mm) long. However, the actual dimensions of a typical CMU are 7⅝" (194 mm) deep×7⅝" (194 mm) high×15⅝" (397 mm) long. CMUs normally are used with mortar, and the ⅜" (9 mm) difference in size is to allow for the mortar.

Segmental wall system (SWS) units typically are used for retaining walls. They usually share the same basic shape and structure as CMUs, and may be made of exactly the same materials, or a somewhat better grade or color of concrete. However, SWS units have at least one face which is designed to be more aesthetically pleasing than a CMU, and this face is used to form the exposed face of a retaining wall. SWS units are made in much smaller volume than CMUs, but in a wide variety of shapes and sizes. SWS units are more expensive than CMUs, though they are usually priced such that they are a very cost effective way to build a retaining wall, especially in a typical landscaping application. In contrast to CMUs, both the nominal and actual dimensions of a typical SWS unit are 12" (305 mm) deep×8" (203 mm) high×16" (406 mm) long, since they normally are used without mortar. Thus, the typical SWS unit is ⅜" (9 mm) taller than the typical CMU. However, other block size could also be used.

Some SWS units are designed to interlock directly. Others, such as those from ICD Corporation, Lake Elmo, Minn., under the trade mark "Stonewall Select" are designed to use a clip to hold the SWS units in proper position relative to each other. Each Stonewall Select SWS unit has grooves formed in the tops its back side wall (the side wall opposite the aesthetically pleasing face) to accommodate the clips. More details can be found in U.S. Pat. No. 4,920,712 (Dean), the disclosure of which is incorporated herein by reference. Whether clips are used or not, for stability an SWS unit wall normally is built with an angle tapering toward fill.

Grooves such as these can easily and inexpensively be added to the tops and/or bottoms of almost any SWS unit by addition of a temporary or permanent mold insert where a groove needs to be formed. Similarly, indentations can be formed in solid fill CMUs with a temporary or permanent mold insert, if desired.

The present invention provides a plurality of bridges with clips on the ends of each bridge. One of the clips is sized and shaped to fit onto a side wall of a CMU, while the other is sized and shaped to fit into the groove of a side wall of an SWS unit and onto the side wall of the SWS unit, without extending beyond the side wall of the SWS unit. The fit on the side walls should be loose enough to allow the clips to fit over the side walls easily, but to then stay in position when fill is added later (for purposes herein, this will be referred to as fitting "snugly"). The clip on the CMU is sized to provide the same ⅜" (9 mm) spacing that mortar would beyond the height of the CMU wall. This way, the next higher row of CMUs will align with the next higher row of SWS units. The bridge can be on the top or bottom of the SWS units and CMUs, depending where the grooves are on the SWS unit and hollow spaces or indentations are in the CMU. Once in place, the bridge fixes the position and distance of the SWS unit to the connected CMU.

A wall then can be constructed by laying a row of SWS units and a row of CMUs roughly parallel to the SWS units. The rows can be curved, if desired. At least one bridge then is put in place fixing each pair of units together. Any hollow spaces in the units and the space between the rows of units can be filled with gravel, rock or other fill material as each course is laid, or after several courses have been laid. Additional courses of SWS units and CMUs are placed on top of the prior courses, with bridges added to each course. This process is repeated until the desired wall height is reached.

For taller walls, additional rows of block units can be laid in parallel with the prior walls, with bridges extending between each row, and the spaces in and between the rows being filled. The maximum number of rows will be needed at the bottom of the wall, while higher courses can have fewer rows. Thus, a tall wall might have 4 rows for the first few courses, then 3 rows, then 2 rows, and finally just the single row of SWS units for the top few courses.

As will be apparent, one would normally use CMUs for the rows which will be buried, since they are less expensive and aesthetics are not relevant, but spare SWS units can be used if desired.

Differently sized and shaped clips preferably are provided for differently sized and shaped blocks. Preferably, at least one end of the bridge body of the connector has a connector and at least some of the clips are formed as separate components which can mount to the bridge body using the connector. This way the different brackets can be used with a single bridge body design. Different length bridge bodies can be provided to enable different spacing between the rows of the wall. Interconnect brackets may also be provided to connect connectors, to provide variability for the distances between the walls.

This structure provides a very simple way to build a two-stage, or multistage, wall. It can be built by hand, with considerably less excavation than a geogrid structure. For example, to build a 10' (3 m) high wall using concrete blocks which are 30 cm deep, the excavation must go back 8' (2.4 m) from the front of the wall. In contrast, the same height wall with the same height blocks only needs a 5'6" (1.7 M) excavation, 32% less. Even more dramatic, for a 6' (1.8 m) high wall, the excavation required is 55% less.

Finally, a bridge can be used to connect blocks in two opposing walls of SWS units to create a free standing wall, something for which they normally are suitable. This provides added flexibility in landscape design.

BRIEF DESCRIPTION OF THE DRAWINGS

The present invention will be described further with reference to the following drawings.

DETAILED DESCRIPTION

Figure 1:
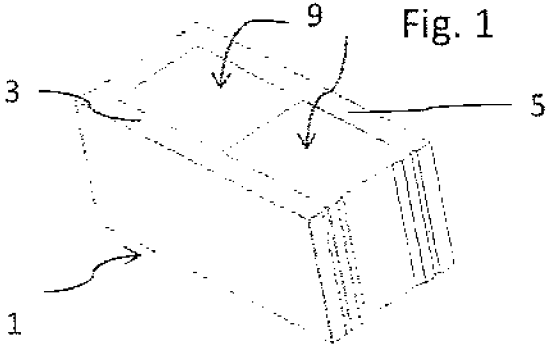
FIG. 1 is an isometric view of a concrete masonry unit (CMU) according to the prior art.

Referring to FIG. 1, a standard prior art concrete masonry unit (CMU) 1 is shown. Such a CMU 1 is formed generally in the shape of a squared-off FIG. 8. For purposes of the present invention, side wall 3 will be referred to as the front side wall, and side wall 5 as the back side wall, it being understood that "front" v "back" is entirely arbitrary. Hollow spaces 9 are formed within the CMU 1, so that the side walls 3, 5 have a standard thickness.

The nominal dimensions of a typical CMU are either 8" (203 mm) deep×8" (203 mm) high×16" (406 mm) long, or 6" (152 mm) deep×8" (203 mm) high×16" (406 mm) long. However, the actual dimensions of a typical CMU of these nominal dimensions are 7⅝" (194 mm) deep×7⅝" (194 mm) high×15⅝" (397 mm) long or 5⅝" (143 mm) deep×7⅝" (194 mm)×15⅝" (397 mm), respectively.

CMUs typically are used with mortar, and the reduced actual size allows space for the mortar, such that the CMU plus the mortar meets the nominal dimension.

Figure 2:
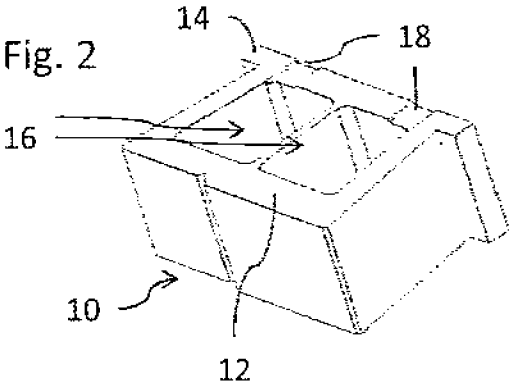
FIG. 2 is an isometric view of a segmental retaining wall (SWS) unit according to the prior art.

FIG. 2 depicts a segmental wall system (SWS) unit 10. It is similar to a CMU, in that it has a front side wall 12 and a back side wall 14, with hollow spaces 16 therebetween. However, in this case the front wall is formed to appear aesthetically pleasing when multiple SWS units are assembled into a wall. The particular block shown is available from ICD Corporation, Lake Elmo, Minn., under the trademark "Stonewall Select". This SWS unit 10 is designed to use a clip to hold the SWS units in proper position relative to each other when assembled into a wall. To enable positioning of the clips, each Stonewall Select SWS unit 10 has grooves 18 formed in the tops its back side wall 14. More details can be found in U.S. Pat. No. 4,920,712 (Dean), the disclosure of which is incorporated herein by reference. While a particular SWS unit is shown here, grooves 18 such as these can easily and inexpensively be added to the tops and/or bottoms of any SWS unit by simple additions of a temporary or permanent mold insertion into the mold for the SWS unit.

In contrast to CMUs, both the nominal and actual dimensions of a typical SWS unit are 12" (305 mm) deep×8" (203 mm) high×16" (406 mm) long, since they normally are used without mortar in a drywall assembly. Thus, the typical SWS unit is ⅜" (10 mm) taller than the typical CMU. According to the present invention, grooves 18 in the SWS unit 10 should be provided of a depth such that the height of the back side wall 14 in the groove matches the height of the typical CMU 1.

Figures 3, 4, 5, 6:
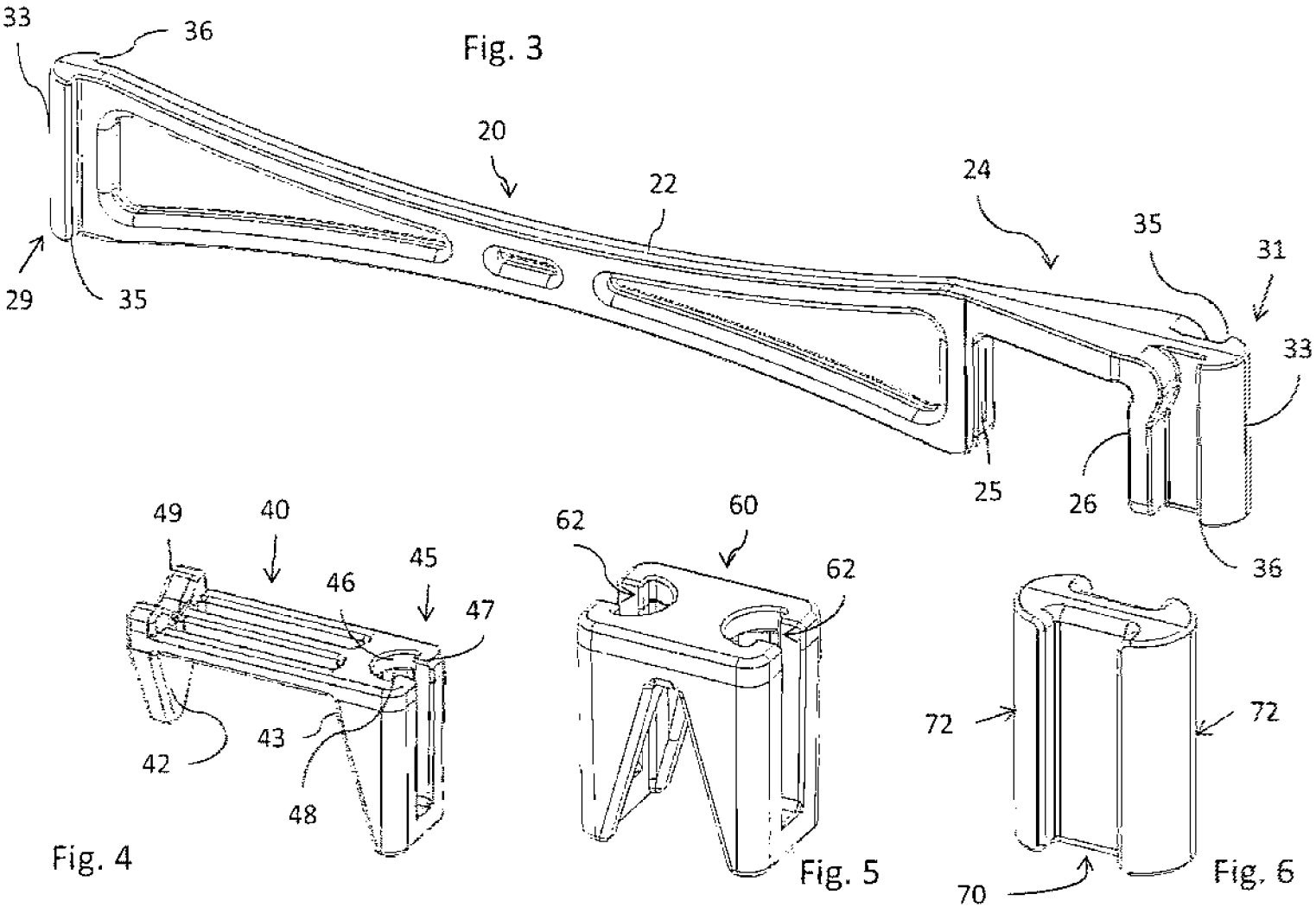
FIG. 3 is an isometric view of a bridge according to the present invention.
FIG. 4 is an isometric view of an SWS clip according to the present invention.
FIG. 5 is an isometric view of a connector receiver bracket according to the present invention.
FIG. 6 is an isometric view of a connector bracket according to the present invention.

FIG. 3 depicts a bridge body 20 according to the present invention. The bridge body 20 has a main body 22 with a CMU clip 24 formed near one end thereof. The walls 25, 26 of the CMU clip 24 are spaced to match the thickness of the CMU side walls 3, 5. The bridge body 20 further has connectors 29, 31 formed at each end thereof. Each connector 29, 31 has a semicircular body 33, with flat surfaces 35, 36 on the base thereof.

FIG. 4 shows an SWS clip 40. The spacing of the walls 42, 43 is such as to match the thickness of the back side wall 14 of an SWS unit 10. One end of the SWS clip 40 has a connector receiver 45 formed in it, with a semicircular portion 46 and flat walls 47,48 which match the shape of the connectors 29, 31 in the bridge body 20. The SWS clip 40 may optionally include a spacer 49 on the top side thereof, which can be used to ensure that the SWS unit in the next higher row is properly positioned with respect to the current SWS unit, as further described in U.S. Pat. No. 4,920,712 (Dean).

Figure 8:
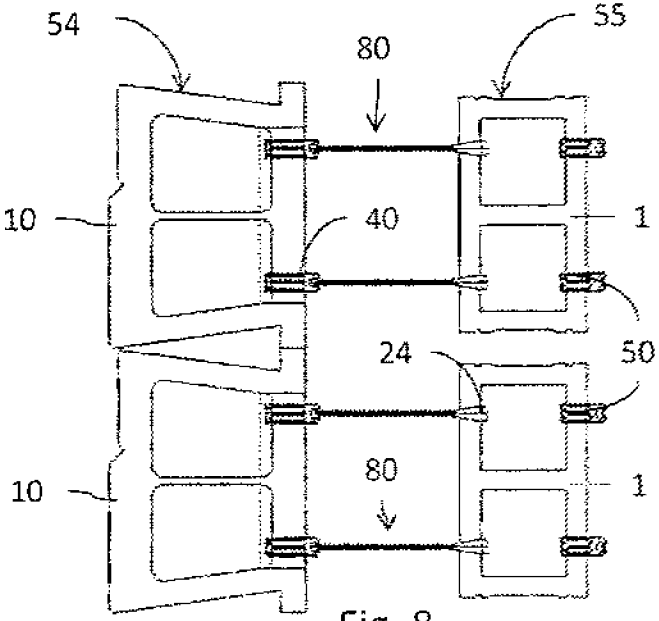
FIG. 8 is a plan view of the wall sub-assembly of FIG. 7.
Figure 7:
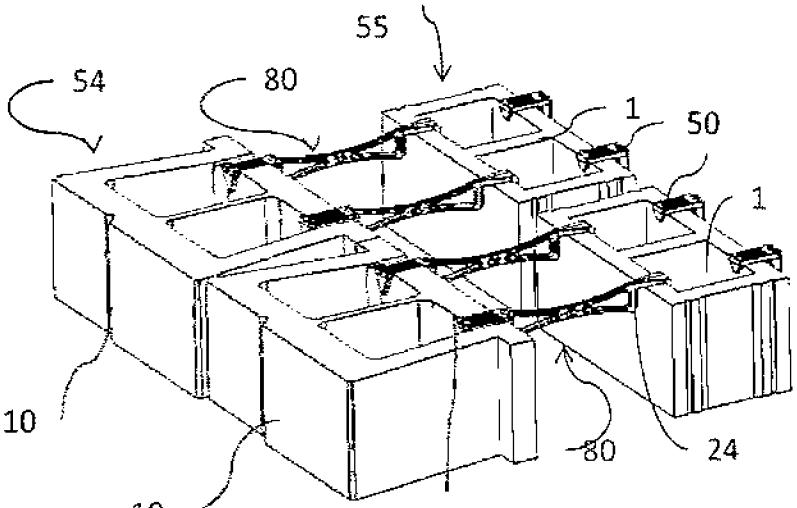
FIG. 7 is an isometric view of a wall sub-assembly according to the present invention.

Referring to FIGS. 7 and 8, a complete bridge 80 is constructed by inserting the connector 29 of the bridge body 20 into the connector receiver 45 of the SWS clip 40. The bridge 80 then is positioned with the CMU clip 24 mounted onto the top of the front side wall of a CMU 1 and the SWS clip 40 mounted onto the top of the back side wall 14 of an SWS unit 10, in one of the grooves 18. If desired, the bridge 80 could be flipped upside down and mounted to the bottoms of the CMU and SWS units instead. Multiple complete bridges 80 are assembled to multiple CMUs and SWS units to build a course of two walls spaced apart by the distance provided by the complete bridges 80.

Preferably, a stand-alone CMU clip 50 is provided on the back side wall 5 of the CMU unit. The stand-alone CMU clip is similar to the SWS clip 40, but is sized to match the wall thickness of a CMU. Providing this stand-alone clip 50 will ensure that when the next course of CMUs is placed on top of the present course, it will align vertically with the taller SWS course.

Once the course is assembled, it is filled with appropriate fill, such as gravel or rock, which provides both mass and drainage. The fill is not shown in any of the drawings for clarity of illustration.

Figure 9:
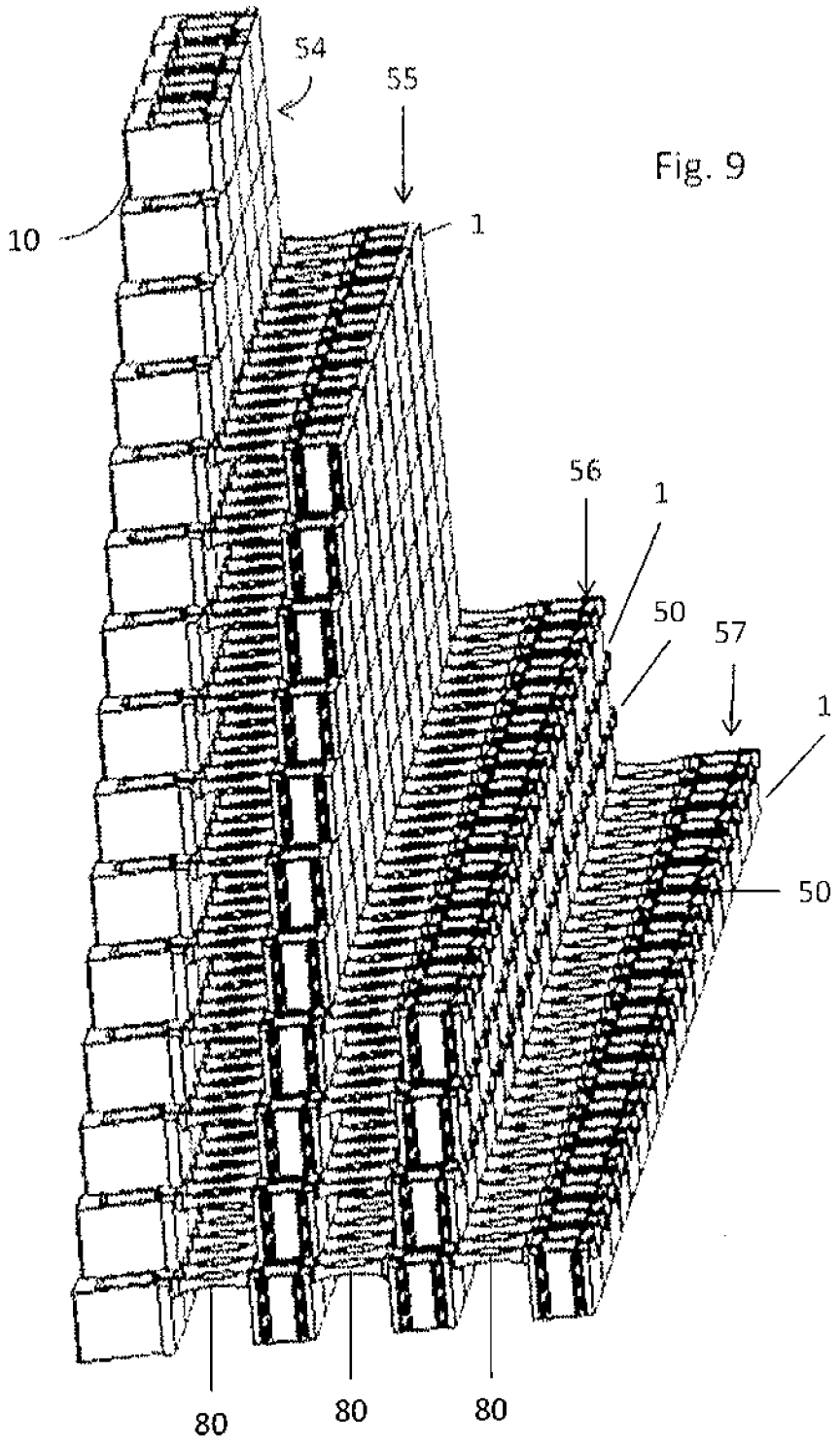
FIG. 9 is an isometric view of a wall assembly according to the present invention.
Figure 10:
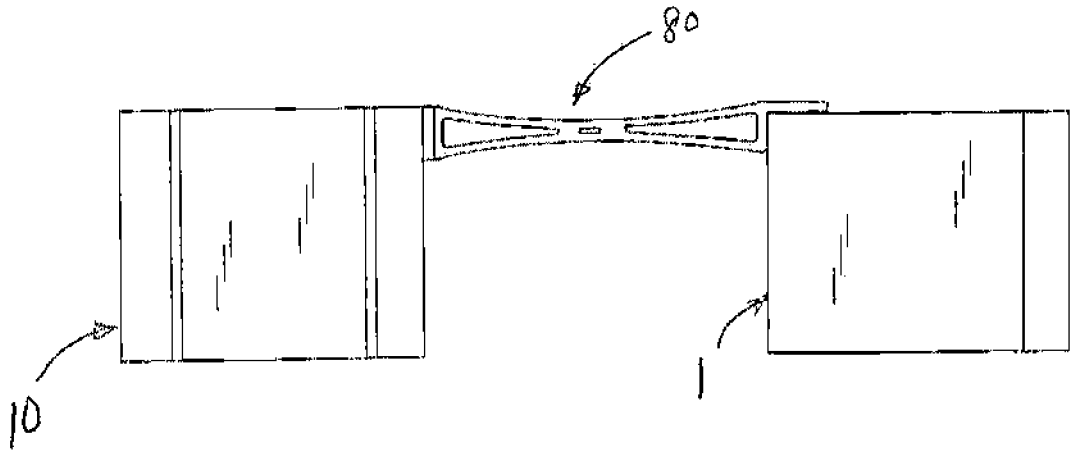
FIG. 10 is a side elevation view of the wall sub-assembly of FIGS. 7 and 8.

As shown in FIG. 9, a wall can be built by placing multiple courses of CMUs 1 and SWS units 10 on top of each prior course, connected with bridges 80 and filled. The optional spacer 49 on top of the SWS clips 40 and stand-alone CMU clips 50 can be used to ensure proper set-back and vertical spacing of the SWS units and CMUs.

A single pair of walls 54, 55 formed by the SWS units and CMUs as shown may not provide sufficient mass to support the ground behind a tall retaining wall. In that case, additional CMU walls 56, 57 can be provided as needed. The exact number of walls 54, 55, 56, 57 needed will depend on the engineering requirements for the particular ground quality and load requirements. However, as a general matter a 15 course, 10' (3 m) wall such as that shown in FIG. 9 will require one SWS wall and three CMU walls, as shown, while a 6' (1.8 m) wall would only require one SWS wall 54 and one CMU wall 55. The extra walls 56, 57 do not need to extend all the way to the height of the SWS wall 54. Instead, they can be shorter, as shown, as needed to match the required load.

The additional CMU walls 56, 57 can be constructed by attaching the stand-alone CMU clip 50 to the connector 29 on the bridge body 20, instead of the SWS connector 40. The assembly then is the same as for the first two walls 54, 55.

An alternative to adding walls 56, 57 is to extend the distance between walls 54, 55, so that additional fill between the walls 54, 55 can provide sufficient additional mass to meet the engineering requirements for the wall. This can be accomplished by providing bridge bodies 20 in a variety of lengths. Alternatively, a connector receiver clip 60 such as that shown in FIG. 5 can be used. The connector receiver clip 60 has connector receivers 62 similar to the connector receiver 45 in the SWS clip 40, formed on either side thereof. A connector 29 or connector 33 on two bridge bodies 20 then can be inserted into the connector receivers 60 in the connector receiver clip 60. Multiple bridge bodies 20 and connector receiver clips 60 can be assembled serially in this fashion, if desired and if the materials from which they are formed have sufficient tensile strength to handle the load. With different size bridge bodies 20 and connector receiver clips 60, wall spacing can be provided to cover a wide range of sizes.

Another situation which may arise is a desire to position two walls very tightly, e.g., for a non-retaining, stand-alone wall. This can be accomplished by using a connector clip 70 such as that shown in FIG. 6. The connector clip 70 has a connector 72 formed on each side, which matches the connectors on the bridge body 20. The connector 72 is essentially a very, very short bridge body, and clips, such as the SWS clip 40 or the stand-alone CMU clip 50, can be connected to either side of the connector clip 70 in the same manner as to bridge body 20, or in combination with multiple bridge bodies 20 and clips. This will provide a very short bridge 80 to hold two walls close together. The exact mix of clips can be varied to match the building units being used, for example, if SWS units 10 are being used on both sides of the wall, then two SWS clips 40 would be used, instead of one SWS clip 40 and one stand-alone CMU clip 50.

All of the bridge, clip and connector components described preferably are formed using injection molded, fiberglass reinforced polymers, to provide strong, durable, corrosion resist and low cost components. However, any suitable material may be used, such as other polymers, metals and ceramics. Thus, a method and apparatus for constructing multi-stage walls have been presented in the foregoing description with reference to specific embodiments, but many variations could be made thereto within the scope of the present invention. For example, the CMU clip 24 has been shown molded into the bridge body 20, but the bridge body 20 could be formed simply with a connector 29 at both ends, and a stand-alone CMU clip 50 used instead of the CMU clip 24. The SWS units 10 are shown as having grooves 18 in their back side wall 14, but the entire back side wall 14 could be made shorter instead.

It will be appreciated that various modifications to the referenced embodiments may be made without departing from the scope the following claims.

We claim:

1. A method for building a multistage wall comprising:

a. providing:

i. a plurality of first blocks, each of the first blocks having first and second spaced apart side walls defining a hollow core therebetween and at least one groove is formed in a top surface of the first side wall of the first blocks;

ii. a plurality of second blocks, each of the second blocks having first and second spaced apart side walls defining a hollow core therebetween, the first blocks being taller than the second blocks; and iii. a plurality of bridges to connect between first and second blocks, wherein each bridge has a bridge body and two ends, a first clip contiguous to one end of the bridge, the first clip being shaped to snugly fit onto the first side wall of one of the first blocks in the groove formed therein, a second clip contiguous to the other end of the bridge, the second clip being shaped to snugly fit onto the first side wall of the second block, wherein the second clip overlies a top surface of the first side wall of the second block;

b. positioning a portion of the plurality of first blocks to form a course of a first wall, the first side walls of each such block being on the same side of the first wall;

c. positioning a portion of the plurality of second blocks to form a course of a second wall such that the first side wall of each second block is facing the side of the first wall with the first side walls of each first block, the second blocks being spaced by a pre-determined distance from the first wall; and d. placing the first clip of one of the plurality of bridges snugly into the groove of each first block and the second clip of each such bridge snugly onto the top surface of the first wall of the adjacent second block, the pre-determined distance being such as to enable the clips to be positioned in this manner, and wherein the combined height of first side wall of the second block and the second clip when in position on the first side wall of the second block matches the height of the first side wall of the corresponding first block.

2. The method of claim 1, further comprising:

a. positioning a further portion of the plurality of first blocks atop the prior course of first blocks in the first wall with the first side wall of each such first block facing the second wall;

b. positioning a further portion of the plurality of second blocks to form a further course of the second wall such that the first side wall of each second block is facing the first wall;

c. placing the first clip of one of the plurality of bridges snugly into the groove of each such first block and the second clip of each such bridge snugly onto the top surface of the first wall of the adjacent such second block; and d. repeating steps (a) to (c) until the first and second walls reach a desired height.

3. The method of claim 2, further comprising filling the space between the first and second walls and burying the second wall.

4. The method of claim 2, wherein the bridge body further comprises a connector on at least one of its ends and wherein at least one of the clips is shaped to mount to the bridge body using the connector, the method further comprising mounting the clip to the bridge body using the connector.

5. The method of claim 4, further comprising:

a. Providing a plurality of clips, each shaped to fit over the side wall of differently shaped blocks and each shaped to mount to the bridge body using the connector;

b. Selecting an appropriate clip for use with the first and second blocks; and c. Mounting the selected clip to the bridge body using the connector.

6. The method of claim 4, further comprising:

a. Providing a connector receiver bracket shaped to mount to the connectors on two bridge bodies to form an extended bridge;

b. Mounting the connector receiver bracket between two bridge bodies to form an extended bridge body; and c. Placing the extended bridge onto corresponding first and second blocks.

7. The method of claim 4, further comprising:

a. Providing bridge bodies in various lengths, such that the bridge can be of various lengths;

b. Selecting an appropriate length bridge body for the wall spacing desired; and c. Placing the bridge using the appropriate length bridge body onto corresponding first and second blocks.

8. The method of claim 1, further comprising pre-forming the second side wall of the first blocks in a decorative face and not doing so to the second blocks.

9. A method for building a multistage wall comprising:

a. providing:

i. a plurality of first blocks, each of the first blocks having first and second spaced apart side walls defining a hollow core therebetween and at least one groove formed in a top surface of the first side wall of the first blocks, and the second side wall being formed in a decorative face;

ii. a plurality of second blocks, each of the second blocks having first and second spaced apart side walls defining a hollow core therebetween and at least one groove formed in a top surface of the first side wall of the second blocks, the second blocks being of the same height as the first blocks, and the second side wall being formed in a decorative face; and iii. a plurality of bridges to connect between the first and second blocks, wherein each bridge has a bridge body and two ends, a first clip contiguous to one end of the bridge, the first clip being shaped to snugly fit onto the first side wall of one of the first blocks in the groove formed therein, a second clip contiguous to the other end of the bridge, the second clip being shaped to snugly fit onto the first side wall of one of the second blocks in the groove formed therein;

b. positioning a portion of the plurality of first blocks to form a course of a first wall, the first side walls of each such block being on the same side of the first wall; and c. positioning a portion of the plurality of second blocks to form a course of a second wall such that the first side wall of each second block is facing the side of the first wall with the first side walls of each first block, the second blocks being spaced by a pre-determined distance from the first wall;

d. placing the first clip of one of the plurality of bridges snugly into the groove of each first block and the second clip of each such bridge snugly into the groove of the adjacent second block, the pre-determined distance being such as to enable the clips to be positioned in this manner.

10. The method of claim 9, further comprising:

a. positioning a further portion of the plurality of first blocks atop the prior course of first blocks in the first wall such that the first side wall of each first block is facing the second wall;

b. positioning a further portion of the plurality of second blocks atop the prior course of second blocks in the second wall such that the first side wall of each second block is facing the first wall; and c. placing the first clip of one of the plurality of bridges snugly into the groove of each such first block and the second clip of each such bridge snugly into the groove of each adjacent such second block; and d. repeating steps (a) to (c) until the first and second walls reach a desired height.

11. The method of claim 10, further comprising filling the space between the first and second walls.

12. The method of claim 10, wherein the bridge body further comprises a connector on at least one of its ends and wherein at least one of the clips is shaped to mount to the bridge body using the connector, the method further comprising mounting the clip to the bridge body using the connector.

13. The method of claim 12, further comprising:

a. Providing a plurality of clips, each shaped to fit over the side wall of differently shaped blocks and each shaped to mount to the bridge body using the connector;

b. Selecting an appropriate clip for use with the first and second blocks; and c. Mounting the selected clip to the bridge body using the connector.

14. The method of claim 12, further comprising:

a. Providing a connector receiver bracket shaped to mount to the connectors on two bridge bodies to form an extended bridge;

b. Mounting the connector receiver bracket between two bridge bodies to form an extended bridge body, and c. Placing the extended bridge onto corresponding first and second blocks.

15. The method of claim 12, further comprising:

a. Providing bridge bodies in various lengths, such that the bridge can be of various lengths;

b. Selecting an appropriate length bridge body for the wall spacing desired; and c. Placing the bridge using the appropriate length bridge body onto corresponding first and second blocks.

* * * * *